US007712155B1

(12) United States Patent
Pantoja

(10) Patent No.: US 7,712,155 B1
(45) Date of Patent: May 11, 2010

(54) RELEASABLY FASTENING APPAREL BELT

(76) Inventor: Patricia Pantoja, 11024 Montgomery NE #306, Albuquerque, NM (US) 87111

( * ) Notice: Subject to any disclaimer, the term of this patent is extended or adjusted under 35 U.S.C. 154(b) by 36 days.

(21) Appl. No.: 12/077,839

(22) Filed: Mar. 21, 2008

(51) Int. Cl.
*A41F 9/00* (2006.01)

(52) U.S. Cl. ..... 2/321

(58) Field of Classification Search ..... 2/310–320, 2/321, 322, 235, 236, 338
See application file for complete search history.

(56) References Cited

U.S. PATENT DOCUMENTS 2,681,453 A * 6/1954 Lane ..... 2/322
3,374,636 A * 3/1968 Mason ..... 405/186
4,173,794 A * 11/1979 Nichols ..... 2/322
4,179,755 A * 12/1979 Clark ..... 2/322
4,203,167 A * 5/1980 Collins ..... 2/322
4,715,839 A * 12/1987 Ford et al. ..... 446/28
4,999,853 A 3/1991 Tanner
5,309,575 A * 5/1994 Lookhoof ..... 2/322
5,519,893 A * 5/1996 Silver ..... 2/321
5,762,619 A * 6/1998 Simon ..... 602/19
5,797,171 A * 8/1998 Nelson ..... 24/600.5
6,678,898 B2 * 1/2004 Jones et al. ..... 2/321
2005/0060791 A1 3/2005 Garrett

* cited by examiner

*Primary Examiner*—Tejash Patel
(74) *Attorney, Agent, or Firm*—Gina T. Constant

(57) ABSTRACT

A releasably fastening apparel belt that uses a releasable fastening means, such as VELCRO®-type hook and loop fastener, which, compared to the traditional buckling and unbuckling process, is much more user-friendly for those of limited manual dexterity. A buckle assembly moveably fixed with respect to the portion of the belt having notches for the buckle's tongue gives the belt the appearance of being a traditional belt.

5 Claims, 4 Drawing Sheets

RELEASABLY FASTENING APPAREL BELT

FIELD OF THE INVENTION

The present invention relates to a clothing accessory known as an apparel belt.

BACKGROUND OF THE INVENTION

Apparel belts have been in existence for many decades and in many forms. Most trouser pants have belt loops sewn around the waist to accommodate an apparel belt, which acts to hold the trousers up. A typical belt consists of one continuous strip of sturdy material, such as leather, rope or tightly woven cotton, with a belt buckle and tongue attached to one end and a series of notches punched out of the other end. The user wraps the belt around his or her waist and then feeds the notched end through the buckle, inserts the buckle's tongue through the notched hole and then feeds the rest of the notched end through a belt loop to secure the belt in place. The buckling and unbuckling of belts typically requires the use of two hands and a certain level of manual dexterity. This can present an insurmountable challenge for some persons, for example people with disabilities affecting their dexterity. For these people, a belt that can easily be put on and taken off but that still functions as a traditional belt and gives the appearance of being a traditional belt is highly desirable. While there are a few examples in the prior art of belts using hook and loop type fasteners (Velcro®) in attempts to create such a belt, the present invention has unique and desirable features lacking in the prior art.

For instance, U.S. Pat. No. 6,678,898 to Jones et al. discloses two elongated, flat belt end-tabs designed to be attached to opposite ends of a torso-encircling strap. Each end tab is fitted with VELCRO®-type hook and loop fasteners for securing the belt in place. A decorative buckle is mounted to the topside of one of the end tabs to give the appearance of being fastened with a buckle.

U.S. Pat. No. 4,999,853 to Tanner discloses a belt comprised of two portions attached together by stitching or fastening. Attached to the terminal end of the first portion is a simple buckle loop. A strip of VELCRO®-type hook and loop fastener is attached to the inside of the second portion. When the end of the second portion is threaded through the buckle loop on the first portion and looped back upon itself, the VELCRO®-type hook and loop fastener secures the belt to itself. The first portion has a decorative front portion attached to it.

U.S. Patent App. No. 2005/0060791 to Garrett discloses a belt with a lead end and a following end. The loop side of the VELCRO®-type hook and loop fastener is attached to the outside of the lead end and the hook side of the VELCRO®-type hook and loop fastener is attached to the inside of the following end. The lead end is fed through the belt loops and the following end is attached to the lead end by joining the hook and loop sides of the VELCRO®-type hook and loop fastener.

SUMMARY OF THE INVENTION

The present invention is a releasably fastening apparel belt comprising a continuous strip of leather or similar material, and an outer end and an inner end such that when the belt is wrapped around the waist of the user, the outer and inner ends overlap, the outer end being furthest from the user. The outer end includes a number of belt notches. A belt buckle assembly comprising a buckle and a tongue is fixedly attached to one end of a buckle strap. The outer end of the belt is fed through the buckle, and the tongue extends through one of the belt notches. The outer end of the belt is fed through a belt loop such that a portion of the belt loop is situated between the buckle strap and the outer end of the belt. The buckle strap is then secured to the outer end of the belt, thereby holding the belt loop in place. VELCRO®-type hook and loop fastener, or any other type fastener, is used to detachably secure the ends of the belt together in an overlapping fashion.

DETAILED DESCRIPTION OF THE PREFERRED EMBODIMENT

Figure 1:
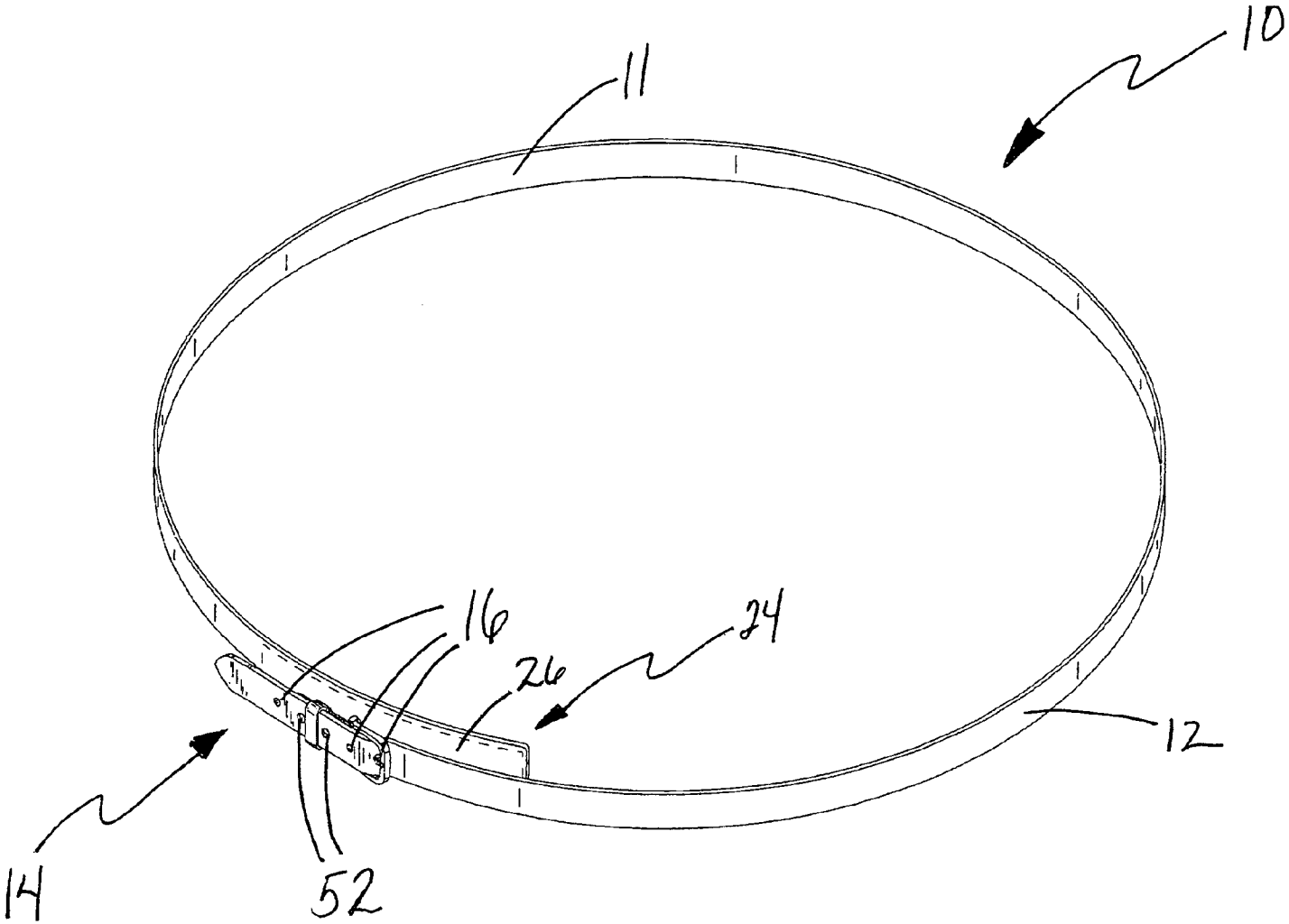
FIG. 1 is a perspective view of the present releasably fastening apparel belt.
Figure 2:
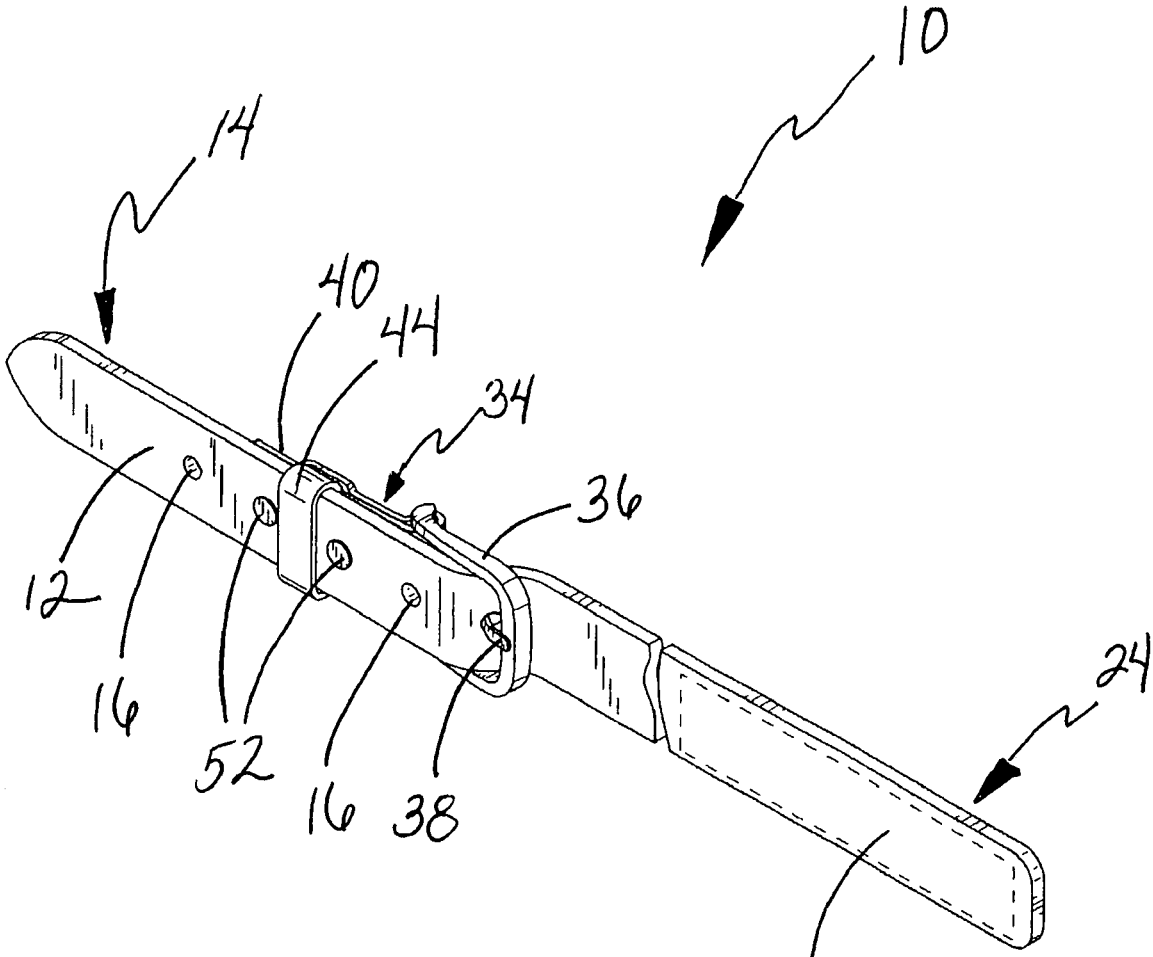
FIG. 2 is a perspective view of the present releasably fastening apparel belt with a break in the belt being substituted for a uniform length of a portion of the continuous strip between the outer and inner ends.

With reference to the figures, the preferred embodiment of the present invention will now be described. The releasably fastening apparel belt 10 is comprised of an outer end 14, an inner surface 11, an inner end 24, an outer surface 12, and a belt buckle assembly 34 (more visibly depicted in FIGS. 3 and 4). The outer end 14 includes a plurality of belt notches 16, preferably apertures. When wrapped around the waist of a user, the outer and inner ends 14, 24 overlap such that the outer end 14 is furthest from the user. A means for detachably securing 26, 28 the outer surface 12 of the inner end 24 of the belt 10 to the inner surface 11 of the outer end 14 of the belt is also provided. Preferably, that means for detachably securing 26, 28 is of the VELCRO®-type hook and loop fastener variety.

Figure 3:
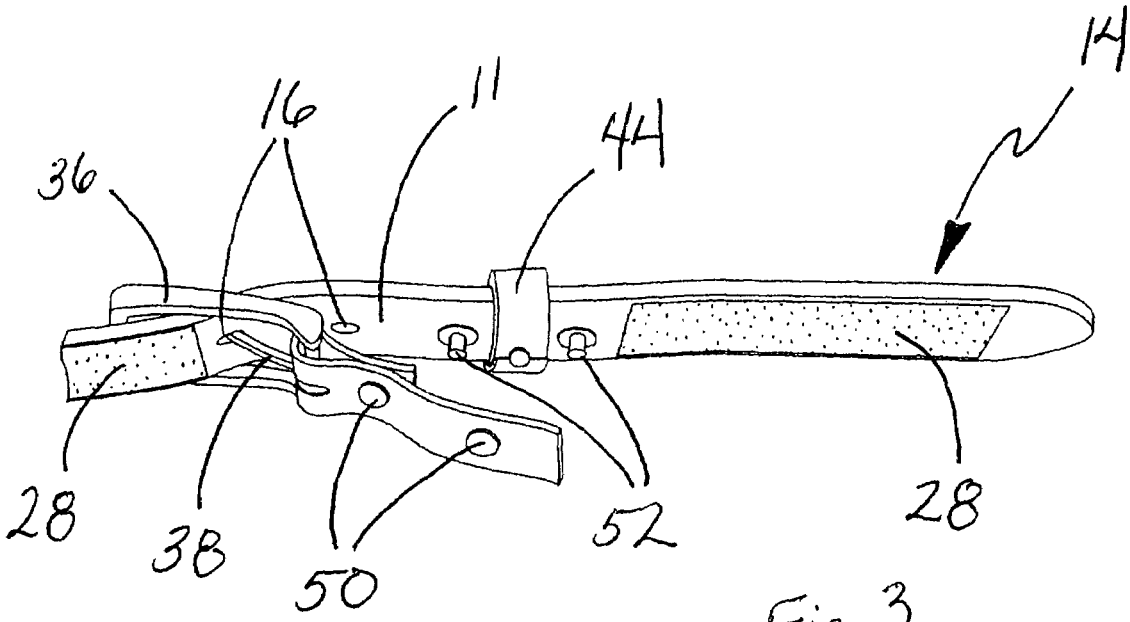
FIG. 3 is a perspective view of the belt buckle assembly positioned near, but unattached to, the outer end.
Figure 4:
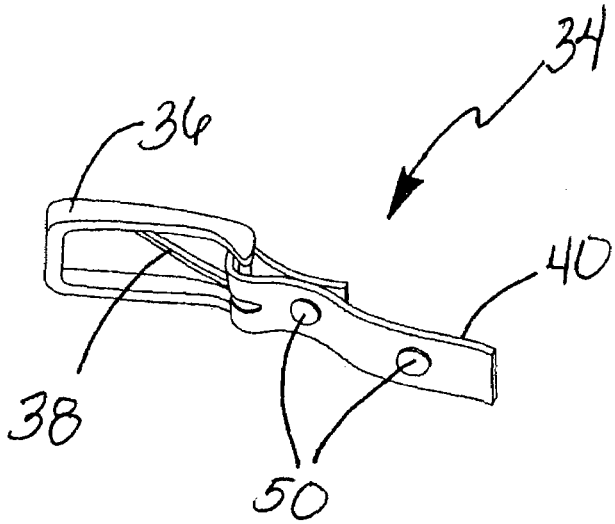
FIG. 4 is a perspective view of the belt buckle assembly portion of the present releasably fastening apparel belt.
Figure 5:
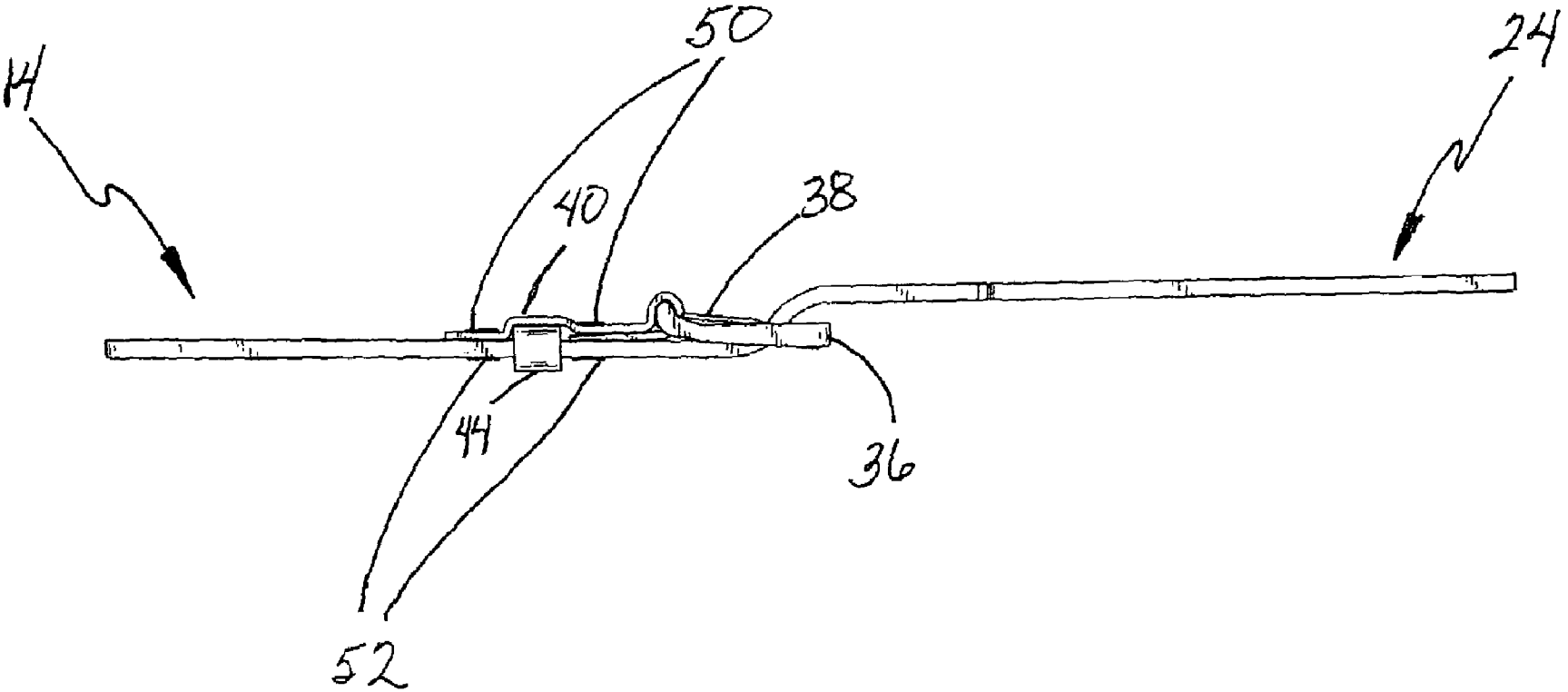
FIG. 5 is a top view of the present releasably fastening apparel belt with a break in the belt being substituted for a uniform length of a portion of the continuous strip between the outer and inner ends.

With reference to FIGS. 3 and 4, the belt buckle assembly 34 is comprised of a buckle 36 and a tongue 38 fixedly attached to one end of a buckle strap 40, and a belt loop 44. When outer end 14 of belt 10 passes through buckle 36, tongue 38 extends through one of the belt notches 16. Buckle strap 40 is secured to outer end 14 preferably with the use of a snap mechanism comprising a male and a female component of the snap. Female components 50 are located on buckle strap 40 in a fashion such that the operative portion of female components 50 faces inner surface 11. Male components 52 are located on outer end 14, in order to maintain equidistant spacing between notches 16 and male components 52 of the snap mechanisms. The male components are oriented in a manner such that they face the operative portions of female components 50 to allow female and male components 50, 52 to snap together and secure buckle strap 40 to outer end 14. However, outer end 14 of belt 10 is fed through belt loop 44 such that a portion of belt loop 44 is located between buckle strap 40 and outer end 14 of belt 10, as well as being situated with one each of components 50 and 52 on either side of the loop. Buckle strap 40 is then secured to outer end 14 with the snaps, thereby holding belt loop 44 in place. In this manner, the present invention may then be wrapped around the waist of a user with outer end 14 overlapping inner end 11 such that means for detachably securing 26, 28 come into contact and hold the belt in place and releasably secure it at a circumference as chosen by the user. However, the belt, when so wrapped around a user's waist (not depicted), will still provide the outward appearance to others that it is a typical apparel belt due to the buckle strap assembly being movably secured to outer end 14, rather than having a traditional buckle and tongue affixed to inner end 11 as is done in prior art apparel belts.

In an alternative embodiment, male components 52 of snap mechanisms are of the removable variety. A plurality of notches 16 are located on the outer end 14 and are spaced equidistantly apart. Removable male components 52 of snap mechanisms can be installed in any two adjacent notches 16. Moving the removable male components 52 from one set of adjacent notches 16 to another, also relocates belt buckle assembly 34 such that when outer end 14 of belt 10 passes through buckle 36, tongue 38 extends through a different belt notch 16, thus changing the outward appearance of the belt 10 and allowing for adjustments in sizing.

Whereas the figures and descriptions have illustrated and described the concept and preferred embodiment of the present invention, it should be apparent to those skilled in the art that various changes may be made in the form of the invention without affecting the scope thereof. The detailed description above and figures are not intended in any way to limit the broad features or principles of the invention, or the scope of patent monopoly to be granted.

I claim:

1. A releasably fastening apparel belt for wearing around a user's waist comprising:

a. an outer end, an inner end, an outer surface and an inner surface, wherein when wrapped around the waist of the user, said outer end and said inner end overlap with said outer end being further from the user's waist than said inner end, and said inner surface of said outer end and said outer surface of said inner end interface when said ends are overlapped;

b. said outer end having at least one belt notch comprising an aperture in said outer end;

c. a belt buckle assembly comprising a buckle and a tongue fixedly attached to one end of a buckle strap, said outer end of said belt passing through said buckle, said tongue extending through said at least one belt notch;

d. a means for removably attaching said buckle strap to said inner surface of said outer end of said belt;

e. a belt loop encircling said outer end of said belt, said belt loop being held in place by encircling the outer end at a position directly between said buckle strap and said outer end; and f. a means for detachably securing the outer surface of the inner end of the belt to the inner surface of the outer end of the belt.

2. The releasably fastening apparel belt of claim 1 wherein the means for detachably securing the outer surface of the inner end of the belt to the inner surface of the outer end of the belt includes an outer hook and loop fastening means on the inner surface of the outer end, and an inner hook and loop fastening means on the outer surface of the inner end.

3. The releasably fastening apparel belt of claim 1 wherein said means for removably attaching said buckle strap to said inner surface of said outer end of said belt comprises two snaps.

4. The releasably fastening apparel belt of claim 3 wherein said snaps are positioned on said buckle strap and said outer end such that one snap is located on either side of said belt loop.

5. The releasably fastening apparel belt of claim 3 wherein said snaps are comprised of two removable male portions located on said outer end and two female portions located on said buckle strap wherein said removable male portions can be located in any adjacent pair of said notches.

* * * * *